US006306261B1

(12) United States Patent
Meschenmoser et al.

(10) Patent No.: US 6,306,261 B1
(45) Date of Patent: Oct. 23, 2001

(54) DEWATERING DEVICE AND PROCESS AND GLAZING DEVICE AND PROCESS

(75) Inventors: Andreas Meschenmoser, Horgenzell; Joachim Henssler, Ravensburg, both of (DE); Walter Holzer, Hofstetten (AT)

(73) Assignee: Voith Sulzer Papiertechnik GmbH, Heidenheim (DE)

( * ) Notice: Subject to any disclaimer, the term of this patent is extended or adjusted under 35 U.S.C. 154(b) by 0 days.

(21) Appl. No.: 09/651,264

(22) Filed: Aug. 30, 2000

(30) Foreign Application Priority Data

Aug. 31, 1999 (DE) ..... 199 41 336

(51) Int. Cl.[7] ..... D21F 3/00; D21F 11/00

(52) U.S. Cl. ..... 162/358.5; 162/206; 162/358.3

(58) Field of Search ..... 162/203, 205, 162/206, 274, 306, 358.1, 358.2, 358.3, 358.4, 358.5, 359.1, 360.2, 360.3, 361; 428/156; 492/7

(56) References Cited

U.S. PATENT DOCUMENTS

| | | | | |
|---|---|---|---|---|
| 4,233,011 | * | 11/1980 | Bolender et al. | 425/143 |
| 4,506,456 | * | 3/1985 | Lehtinen | 34/12 |
| 4,555,305 | * | 11/1985 | Steiner et al. | 162/205 |
| 4,556,454 | * | 12/1985 | Dahl et al. | 162/358.3 |
| 5,047,122 | * | 9/1991 | Crouse et al. | 162/206 |
| 5,071,513 | * | 12/1991 | Bluhm et al. | 162/206 |
| 5,152,874 | * | 10/1992 | Keller | 162/358.4 |
| 5,302,252 | * | 4/1994 | Gotz | 162/358.5 |
| 5,709,778 | * | 1/1998 | Kade et al. | 162/358.3 |
| 5,787,603 | | 8/1998 | Steiner et al. | 34/117 |
| 5,813,513 | * | 9/1998 | Taube | 198/803.14 |

FOREIGN PATENT DOCUMENTS

| | | | |
|---|---|---|---|
| 2657041 | 7/1977 | (DE) | D21F/5/00 |
| 3203571 | 10/1982 | (DE) | F26B/13/00 |
| 3607941 | 10/1988 | (DE) | F26B/5/12 |
| 3705241 | 1/1992 | (DE) | D21F/3/00 |
| 3832324 | 4/1992 | (DE) | D21F/3/08 |
| 69112619 | 2/1996 | (DE) | D21F/3/08 |
| 19540898 | 5/1997 | (DE) | D21F/3/02 |
| 19544979 | 6/1997 | (DE) | D21F/3/02 |
| 19617801 | 11/1997 | (DE) | D21F/3/02 |
| 3532853 | 9/1998 | (DE) | D21F/5/02 |
| 19723163 | 12/1998 | (DE) | F26B/13/10 |
| 19723172 | 12/1998 | (DE) | D21F/3/02 |
| 890675 | 1/1999 | (EP) | D21F/5/02 |

* cited by examiner

*Primary Examiner*—Peter Chin
*Assistant Examiner*—Eric Hug
(74) *Attorney, Agent, or Firm*—Greenblum & Bernstein, P.L.C.

(57) ABSTRACT

Dewatering device and process of a machine for at least one of production and processing of a material web, as well as a glazing device an process. The dewatering device includes a circulating flexible continuous belt and an opposite surface. The circulating flexible continuous belt and the opposite surface are arranged to form a nip elongated in a web travel direction, and at least one screen is adapted to guide the material web through the nip. A saddle, which is arranged to support the circulating flexible continuous belt, is segmented in the web travel direction into saddle segments connected to each other. The saddle segments are at least partially separately pressurized. The dewatering process includes guiding the material web through the nip, and at least partially separately pressurizing the saddle segments against the opposite surface. The glazing device includes a heated roller composed of a saddle roller and a mating roller, and the heated roller and the mating roller are arranged to form a nip elongated in a web travel direction. The saddle roller may include a flexible roller jacket supported by a saddle which is segmented in the web travel direction into saddle segments connected to each other. The saddle segments are at least partially separately pressurized. The glazing process includes guiding the material web through the nip, and at least partially separately pressurizing the saddle segments against the mating roller.

32 Claims, 4 Drawing Sheets

DEWATERING DEVICE AND PROCESS AND GLAZING DEVICE AND PROCESS

CROSS-REFERENCE TO RELATED APPLICATIONS

The present application claims priority under 35 U.S.C. §119 of German Patent Application No. 199 41 336.3, filed on Aug. 31, 1999, the disclosure of which is expressly incorporated by reference herein in its entirety.

BACKGROUND OF THE INVENTION

1. Field of the Invention

The present invention relates to a dewatering device of a machine for the production and/or processing of a material web, e.g., a paper web or a cardboard web, in which the material web is guided together with at least one screen through a nip which is elongated in the web travel direction. The nip is formed between a circulating flexible continuous belt, which is supported by a saddle, and an opposite surface. The present invention is also related to a glazing device of a machine for the production and/or processing of a material web, e.g., a paper web or a cardboard web, in which the material web is guided between a nip formed between a heated roller and a mating roller.

2. Discussion of Background Information

A dewatering device of the above mentioned type is known, e.g., from DE 197 23 163 A1. It is also known to perform the dewatering between two metal belts of which one is heated and the other is cooled. Moreover, originating from the heated belt, a paper web, a fine screen, and a coarse screen are arranged toward the cooled belt. Arrangements are also known in which the paper web and the screens are guided over a cooled or heated cylinder. Around the cylinder a metal belt is looped which is heated in the case of a cooled cylinder and is cooled in the case of a heated cylinder. The paper web always sits close to the heated surface. Between the paper web and the cooled surface there is at least one screen, usually a fine screen, which is provided close to the paper web and a coarse screen which is located close to the cooled surface. In all of these arrangements, pressure is transmitted during the dewatering process by a pressurized cooling and/or heating medium in the form of a gas or a liquid through an airtight surface such as, e.g., a metal belt to a sandwich formed by the two surfaces of paper, fine screen, and coarse screen (see, e.g., DE-A-26 57 041, FIG. 10; DE-A-32 03 571, FIG. 11; DE-A-35 32 853, FIG. 12).

However, the pressurized liquid requires very expensive constructions concerning the sealing and due to uncompensated forces. A change in the structure pressure applied can only be accomplished with several pressure chambers, which again increase the constructive expense.

Also there are arrangements known in which, during the dewatering process, the pressure is produced mechanically by one or more saddle presses which are pressed against a heated cylinder. In this way, it is possible to reduce the constructive expense necessary for production of the structure pressure and the pressure profile can be predetermined, within certain limits, by the selection of the form of the saddles (see, e.g., EP-A-0 890 675, FIG. 13). However, if only one saddle is used it results in a length of only about 200–300 mm, which is very short. If several saddles are used, the paper is always relieved of pressure between each saddle. This does not allow the construction of a continuous process because the steam pressure inside of the paper must be reduced to the outside pressure after each nip in order to avoid destruction of the paper.

Furthermore, there are also solutions known in which the structure pressure is produced by several pressure rollers against a heated cylinder. Here, too, a continuous process of a structure pressure cannot be created over a longer period of time (cf., e.g., U.S. Pat. No. 5,787,603, FIG. 14).

SUMMARY OF THE INVENTION

The present invention provides a dewatering device of the above mentioned type which enables a continuous process of the structure pressure in the web travel direction over a significantly longer distance during the dewatering process. Furthermore, a coordinating glazing device can be created.

Concerning the dewatering device, the invention includes a saddle segmented in the web travel direction, in which, at least partially, separate pressurization of the saddle segments connected with each other is enabled.

Due to this design, a continuous process of the structure pressure in the web travel direction can be produced over a significantly longer distance during the dewatering process than, e.g., about 300 mm. It is possible, e.g., to monitor the profile of the pressure forces by pressure sensors even during processing and to adjust them in such a way that, especially in the exit area of the pressured area, the steam pressure is small enough to avoid destruction of the paper by the expanding steam still contained in the paper. To this end, appropriate force sensors can be provided, e.g., in the saddle. If the circulating flexible continuous belt is formed, for instance, by a flexible roller jacket, correlating pressure sensors and force sensors can be provided, e.g., in the rotating saddle roller or in the mating roller to the saddle pressure roller.

The saddle can be pressed mechanically against an opposite (opposing) surface in order to apply structure pressure to the material web. Over the sum of the saddle segments a continuous pressure profile is produced which preferably is adjustable during the process. The pressure of the segments can occur on the connection points and/or in between, for instance, with hydraulic stamps.

In a particular embodiment, the saddle segments can at least be partially hinged to one another. In this case the segments can be pressurized at the hinge points and/or in between, accordingly.

In another embodiment, the saddle segments can at least be partially formed by areas of reduced material thickness of the saddle at each point. Thus, the saddle can have, on the side facing away from the nip, several consecutive cuts in the web travel direction.

In a preferable embodiment of the dewatering device according to the invention, different pressure profiles in the nip can be adjusted by appropriate pressurizing of the saddle segments.

The pressure in the nip can also be produced by two saddles facing each other in which at least one of the saddles is segmented.

It is also advantageous when the surface of the flexible continuous belt and/or the opposite surface is structured accordingly, for instance ribbed, to support the pressure equalization in the area of the nip exit.

In another embodiment of the dewatering device according to the invention, the circulating flexible continuous belt is formed by a flexible roller jacket of a saddle roller.

The opposite surface can be formed by a mating roller, e.g., a roller that is supported on the inside, especially a sag (deflection) compensation roller.

In certain cases, it can be useful when the flexible continuous belt that is guided over the saddle is cooled and the opposite surface is heated. In this case, the segmented saddle can have a coolant, e.g., cooling water, flow through it. Alternatively, or additionally, the flexible continuous belt supported by the saddle can also be cooled from the outside and/or inside.

Advantageously, the flexible continuous belt is at least partially cooled on the inside by the lubricant that is used to lubricate the area between the saddle and the continuous belt.

In certain cases, it can also be practical for the screen to be cooled before the nip in the web travel direction.

To increase the heat transfer, the flexible continuous belt can be formed, in particular, by a steel belt.

In another embodiment of the dewatering device according to the invention, the flexible continuous belt guided over the saddle is heated and the opposite surface is cooled.

In an advantageous practical embodiment, the flexible continuous belt and the opposite surface are each formed by a steel belt. Further, the segmented saddle is opposed, preferably, by a saddle that is not segmented and, upon which, the steel belt that forms the opposite surface is supported. Each of the two steel belts is guided, preferably, around two floating idle rollers, preferably sag compensation rollers, and driven by them.

The glazing device according to the invention includes a heated roller composed of a saddle roller with a flexible roller jacket supported in an area of the nip by a saddle segmented in the web travel direction. The saddle segments are connected with one another and can be pressurized separately, at least in part.

The present invention is directed to a dewatering device of a machine for at least one of production and processing of a material web. The dewatering device includes a circulating flexible continuous belt and an opposite surface. The circulating flexible continuous belt and the opposite surface are arranged to form a nip elongated in a web travel direction, and at least one screen is adapted to guide the material web through the nip. A saddle, which is arranged to support the circulating flexible continuous belt, is segmented in the web travel direction into saddle segments connected to each other. The saddle segments are at least partially separately pressurized.

In accordance with a feature of the instant invention, the saddle segments can be at least partially hinged to one another.

In accordance with another feature of the invention, the saddle segments can be at least partially formed by areas of reduced material thickness of the saddle. The saddle may include several consecutive cuts in the web travel direction on a side facing away from the nip. Further, the saddle can include a normal profile region and a relieving region, where the relieving region is composed of the saddle segments.

According to still another feature of the present invention, different pressure profiles can be achieved in the nip by changing the pressurization of the saddle segments.

In accordance with a further feature of the invention, the opposite surface can include a saddle, and a pressure in the nip may be produced between the saddles. The saddle of the opposite surface can be segmented, or the saddle of the opposite surface can be non-segmented.

A surface of at least one of the flexible continuous belt and the opposite surface may be structured and arranged for support of pressure compensation in an exit area of the nip. The surface may be grooved.

The circulating flexible continuous belt can include a flexible roller jacket of a saddle roller.

Moreover, the opposite surface can include a mating roller. The mating roller may include a roller supported on its inside. The mating roller can include a sag compensation roller.

According to a still further feature of the invention, the flexible continuous belt can be cooled and the opposite surface can be heated. A cooling medium may flow through the segmented saddle. The flexible continuous belt may be cooled from one of outside and inside.

In accordance with another feature of the present invention, the flexible continuous belt may be at least partially cooled on an inside by a lubricant provided to lubricate an area between the saddle and the continuous belt.

According to still another feature of the instant invention, the at least one screen can be cooled before the nip, relative to the web travel direction.

In accordance with the present invention, the flexible continuous belt can include a steel belt.

According to another feature of the invention, the flexible continuous belt may be heated and the opposite surface may be cooled.

The flexible continuous belt and the opposite surface may each include a steel belt, and the dewatering device can further include an unsegmented saddle arranged to support the steel belt of the opposite surface. The segmented saddle can be positioned opposite an unsegmented saddle. The invention can further include two floating idle rollers such that the two steel belts can each be guided around and driven by the two floating idle rollers. The two floating idle rollers may include sag compensation rollers.

A separately cooled steel belt can be positioned on a side of the circulating flexible continuous belt.

Further, in accordance with the invention, the material web can include one of a paper and a cardboard web.

The present invention is directed to a glazing device of a machine for at least one of production and processing of a material web. The glazing device includes a heated roller composed of a saddle roller and a mating roller, and the saddle roller and the mating roller are arranged to form a nip elongated in a web travel direction. The saddle roller may include a flexible roller jacket supported by a saddle which is segmented in the web travel direction into saddle segments connected to each other. The saddle segments are at least partially separately pressurized.

According to the instant invention, the material web can include one of a paper and a cardboard web.

The present invention is directed to a process for dewatering a material web in an apparatus that includes a circulating flexible continuous belt and an opposite surface arranged to form a nip elongated in a web travel direction, at least one screen adapted to guide the material web through the nip, and a saddle arranged to support the circulating flexible continuous belt, which is segmented in the web travel direction into saddle segments connected to each other. The process includes guiding the material web through the nip, and at least partially separately pressurizing the saddle segments against the opposite surface.

According to yet another feature of the invention, a pressure profile can be changed by changing the pressure applied to the saddle segments.

The present invention is directed to a process for glazing a material web in an apparatus that includes a heated a heated roller composed of a saddle roller and a mating roller arranged to form a nip elongated in a web travel direction. The saddle roller includes a flexible roller jacket supported by a saddle, in which the saddle is segmented in the web travel direction into saddle segments connected to each other. The process includes guiding the material web through the nip, and at least partially separately pressurizing the saddle segments against the mating roller.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 3:
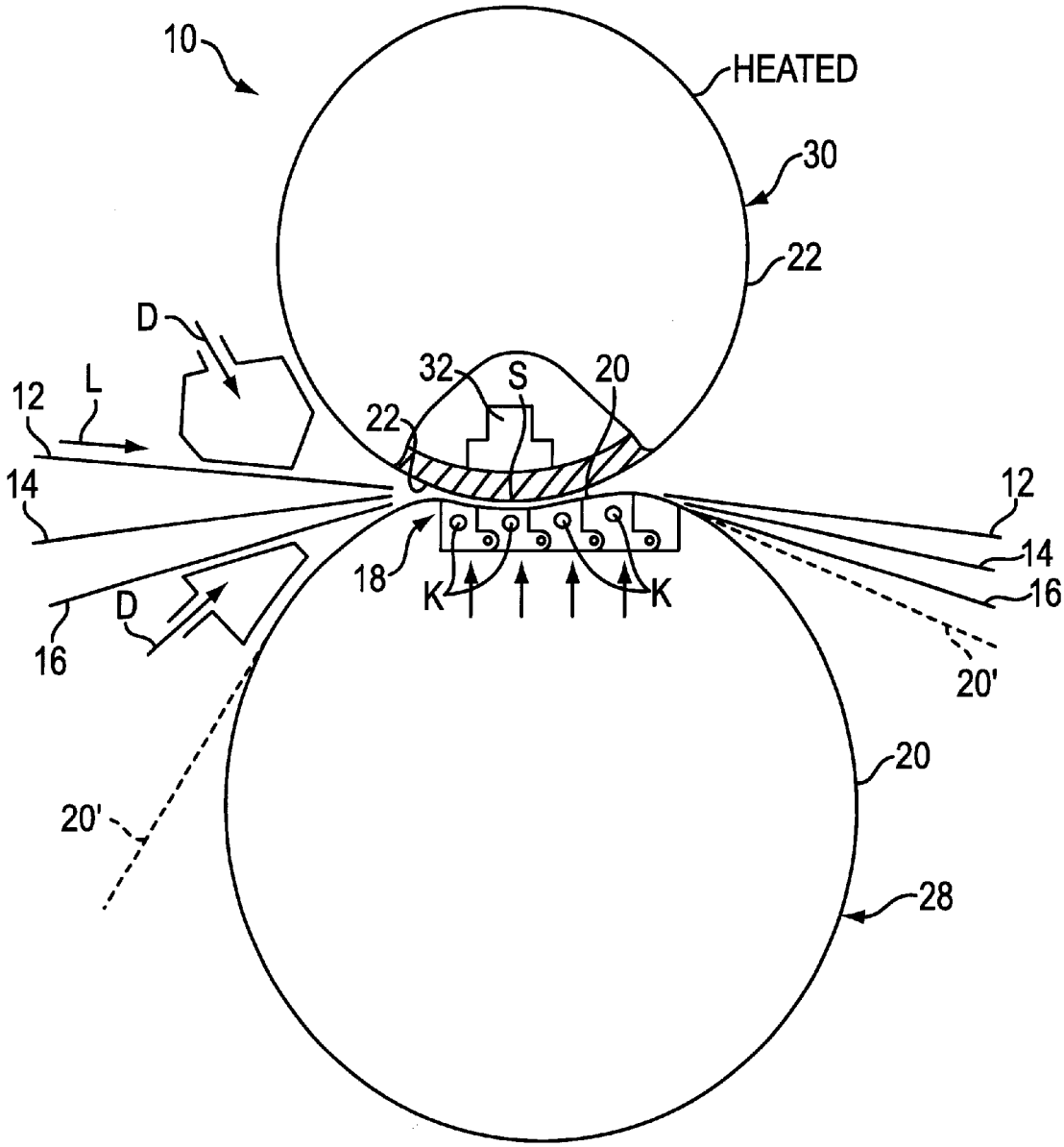
FIG. 3 schematically illustrates a dewatering device with a cooled saddle roller and a heated mating roller.
Figure 4:
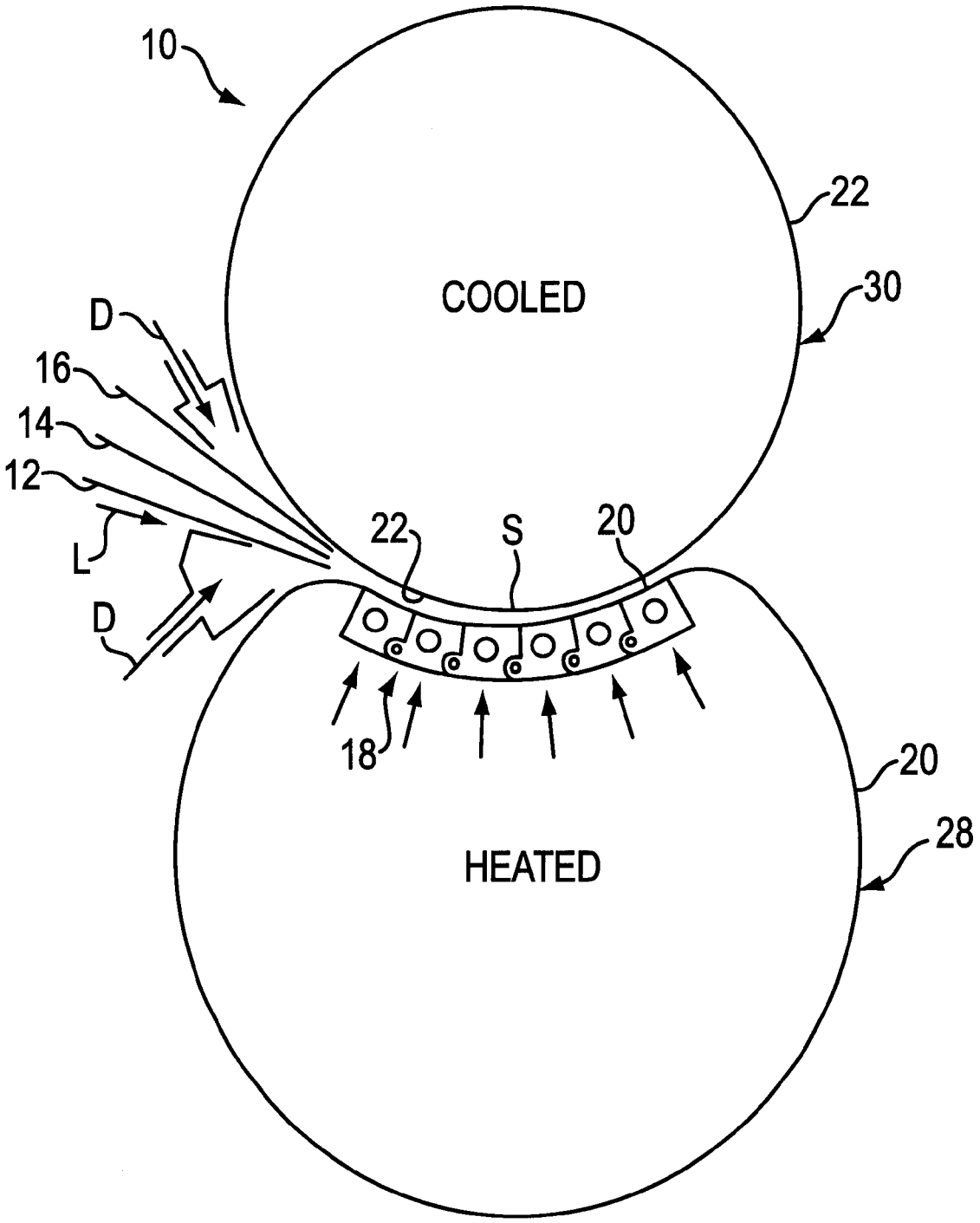
FIG. 4 schematically illustrates another embodiment of a dewatering device with a heated saddle roller and a cooled mating roller.
Figure 5:
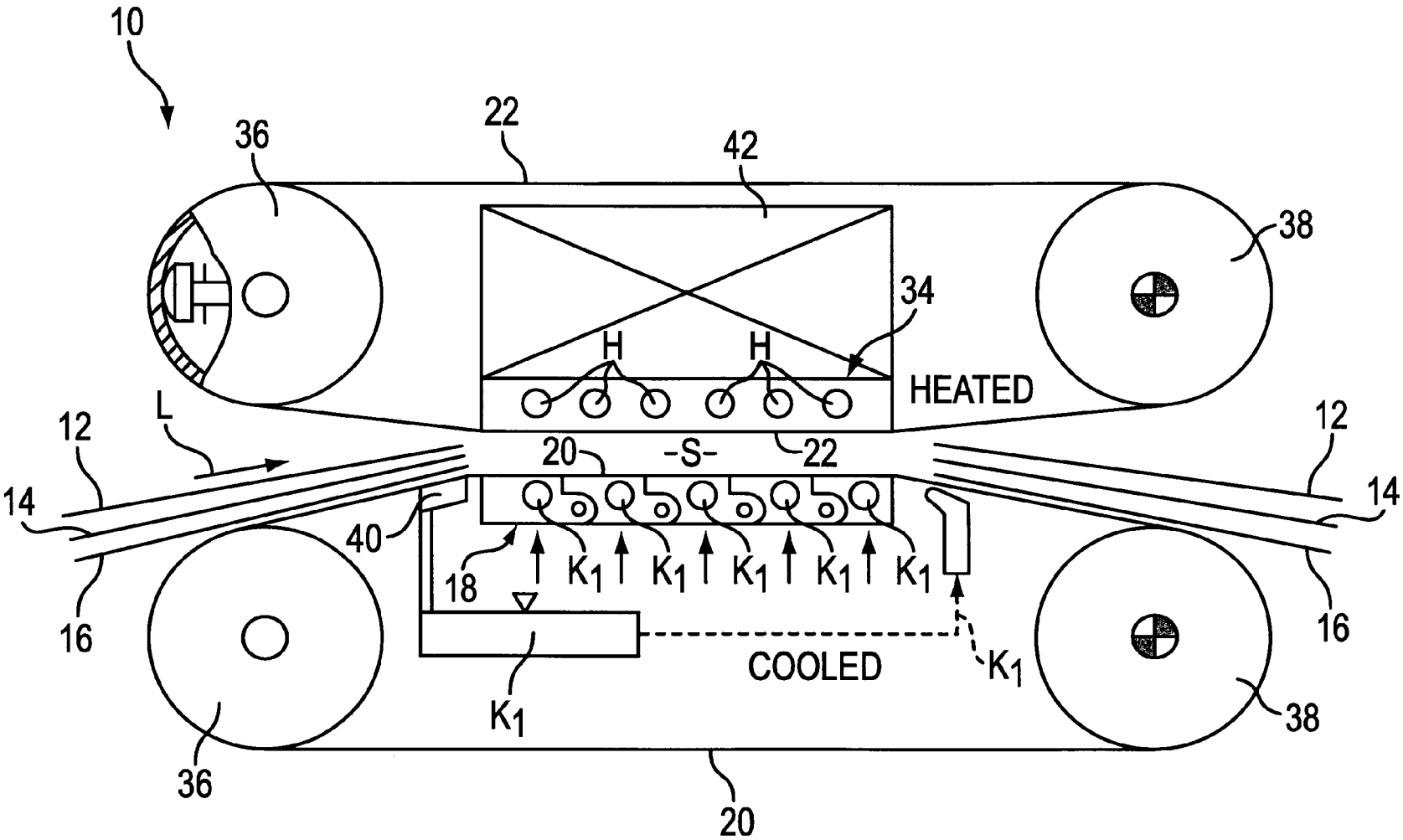
FIG. 5 schematically illustrates another embodiment of a dewatering device with a nip formed between two steel belts.

FIGS. 3 through 5 each depict a purely schematic representation of a dewatering device 10 of a machine for the production and/or processing of a material web 12 which can be, e.g., a paper web or a cardboard web.

Material web 12 is guided together with a finely structured screen 14, that contacts web 12, and a coarsely structured screen 16, through a nip S, which is elongated in a web travel direction L and is formed between a circulating flexible continuous belt 20, that is supported by a saddle 18, and an opposite (opposing; counter) surface 22.

Saddle 18 is segmented in web travel direction L, whereas separate saddle segments 18' (cf. FIGS. 1 and 2), are connected with one another and can at least partially be pressurized separately and/or independently.

Figure 1:
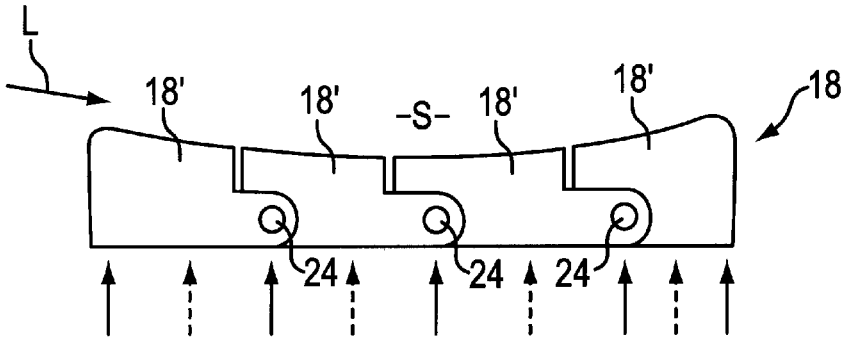
FIG. 1 schematically illustrates a segmented saddle of a dewatering device.
Figure 2A:
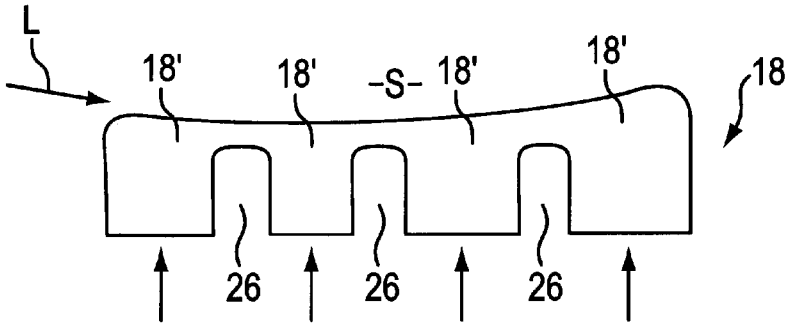
FIGS. 2*a* and 2*b* schematically illustrate other embodiments of a segmented saddle.

FIGS. 1 and 2 depict two embodiments of segmented saddle 18. As depicted in FIG. 1, saddle segments 18' can be hinged together. The pressurizing of saddle segments 18' can occur in hinge points 24 and/or therebetween, e.g., with hydraulic stamps.

Figure 2B:
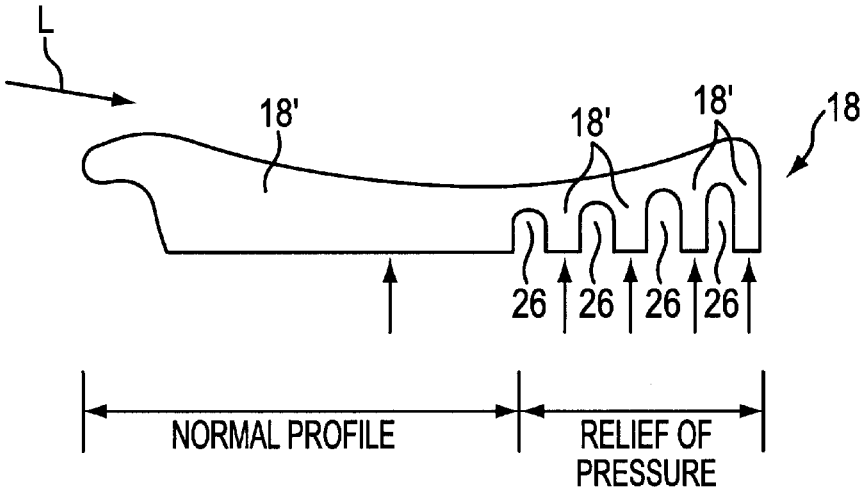

Saddle segments 18' can also be formed, e.g., by areas of reduced material thickness of saddle 18 at each point. Thus, saddle 18 has, in the embodiments according to FIGS. 2*a* and 2*b*, on the side facing away from nip S, several cuts 26 each forming a reduced material thickness, that are consecutively arranged in web travel direction L. As can be seen in FIG. 2*b*, cuts 26 can be provided, e.g., in a "relieving" area adjacent to a "normal-profile" area.

Therefore, saddle 18 is pressed mechanically against opposite surface 22 similar to a saddle press, to exert structure pressure on material web 12. After saddle 18 is divided into segments 18' that are connected with one another, a continuous process of structure pressure results over a relatively long distance in the web travel direction L. This continuous process can stretch over significantly more than, e.g., about 300 mm. The profile of the pressure forces can be monitored by pressure sensors during processing and can be adjusted in such a way that the steam pressure, especially in the area of the exit of the pressure area is small enough to avoid destruction of the paper by expanding steam still contained in the paper. Here, force sensors can be provided in saddle 18 and/or pressure sensors and force sensors inside of circulating flexible continuous belt 20 or in the opposite roller.

In each dewatering device 10, temperatures of, e.g., about 100° C. to about 250° C. and pressures up to, e.g., about 60 bar and preferably up to about 15 bar can prevail. The structure pressure can, as described below by way of example using FIG. 5, also be applied by two saddles facing each other, of which at least one is segmented.

The pressure equalization while leaving the pressure area or nip S can be supported by appropriately shaped or structured surfaces of circulating flexible continuous belt 20 and/or of opposite surface 22. The relevant surfaces can be, e.g., grooved.

To avoid delamination and to control optimal adjustment of the pressure profile of the saddle 18, suitable paper characteristics such as, e.g., the modulus of elasticity and/or the thickness can be measured online during operation. The modulus of elasticity, e.g., can be determined with a suitable ultrasound device. If an increase in the thickness or a reduction in the firmness of the paper is detected, the pressure profile at the end of saddle 18 can be reduced and/or modified until the desired optimum is achieved. Moreover, automatic regulating algorithms can also be defined. For instance, the dewatering process can be calculated in a simulation based on the known and measured parameters, and the pressure profile, as well as the best possible adjustment of the pressure profile, can then be determined. Subsequently, the pressure profile can be adjusted automatically.

In a generally known fashion, screens 14 and 16, and material web 12 can be rinsed with steam D before the introduction into nip S which displaces the extremely poor heat conducting air out of the paper and out of the screens. Alternatively, or additionally, heating with other suitable devices is also possible.

In the embodiments of a dewatering device 10 depicted in FIGS. 3 and 4, circulating flexible continuous belt 20 is formed in each case by a flexible roller jacket of a saddle roller 28 and opposite surface 22 is formed by a mating roller 30. The length of nip S measured in web travel direction L can be, e.g., in the range from about 500 mm to about 1000 mm. Here, the diameters of rollers 28 and 30 can be, e.g., in the range of about 1800 mm. Mating roller 30 can be formed especially by a roller supported on the inside, preferably by a sag (deflection) compensation roller (cf. FIG. 3).

In the embodiment according to FIG. 3, saddle roller 28 is cooled and opposite roller 30 is heated. Here, a coolant K, e.g., cooling water, flows through segmented saddle 18. The friction heat between pressure elements 32 and the jacket of mating roller 30 can be used, if necessary, to support the heating of mating roller 30. Up to about 180° C., all types of heating, inside and outside of the roller, are possible. That means, for heating of mating roller 30, e.g., steam, gas, a heat conducting medium, heating oil, inductive heating, and/or the like can be used. For higher temperatures another type of heat production should be selected in addition to steam.

The jacket of saddle roller 28 can be a so-called "Qualiflex Jacket." Saddle roller 28 is cooled by the flow of coolant, e.g., cooling water, through saddle 18, which is divided into segments. Additionally, the jacket of saddle roller 28 can be cooled from the outside. Additionally or alternatively, the lubricating oil can be used for cooling from the inside. In order to improve the heat transfer for cooling, a roller jacket made from a steel belt is also conceivable. In this case, the sealing on the side has to be designed differently than the presently used saddle rollers, so that the jacket experiences only a uniform deformation (e.g., by a rubber hose).

It is also possible to guide a separate cooled steel belt 20' over the flexible plastic pressure jacket of the saddle pressure roller through nip S (cf. FIG. 3).

Another cooling possibility includes cooling screens 14 and 16 before nip S. A steam valve could then be used only on the paper side. In the embodiment depicted in FIG. 4, saddle roller 20 is heated and mating roller 30 is cooled. Thus, heating occurs from the side of saddle roller 28. If necessary, the heat produced due to the friction of jacket 20 with saddle 18 can also be used for heating nip S.

In the latter case, though, the jacket and the lubricant should include a material which withstands the operating temperatures, e.g., about 140° C. to about 180° C. As already mentioned in connection with the embodiment according to FIG. 3, e.g., jacket 20 could be composed of steel and be provided with a modified seal on its side. When using oil, temperatures of, e.g., about 180° C. are presently conceivable. However, the oil must be transported in an air tight manner, for which, e.g., a nitrogen filling or the like can be provided inside saddle roller 28. Alternatively, sliding materials could be used, e.g., Babbitt metal with embedded graphite.

Generally, the embodiment according to FIG. 4 has at least essentially the same design as the one in FIG. 3. Additionally, the embodiment depicted in FIG. 4 can generally be used also for glazing. In this case, the screens and the steam valve are eliminated and only the paper is guided through the heated nip. Depending on the specific requirements, mating roller 30 can be cooled, uncooled or heated. Likewise, the dry matter can also be increased simultaneously with the glazing by means of the amount of heat introduced.

As especially depicted according to FIG. 5, the pressure in nip S can also be produced by two saddles 18 and 34 positioned opposite to each other in which, e.g., in the present cases only saddle 18 is segmented.

In the embodiment according to FIG. 5, flexible continuous belt 20 guided over segmented saddle 18 and opposite surface 22 are each formed by a steel belt. Segmented saddle 18 is positioned opposite to unsegmented, fixed saddle 34, on which the steel belt that formes opposite surface 22 is supported.

Steel belts 20 and 22 are each guided around two floating idle rollers 36 and 38, e.g., sag compensation rollers, and driven by them.

The friction between steel belts 20 and 22 and idle rollers 36 and 38 can be improved by suitable surfaces of the rollers. For instance, roller surfaces can be provided that are grooved and/or coated with hard metal.

Between idle rollers 36 and 38, the section exposed to structure pressure formed by nip S is formed by pressure saddles 18 and 34 arranged opposite to each other. Saddle 18 can include separately pressurizable segments 18' (cf. FIGS. 1 and 2). Opposite saddle 34 can be fixed, and measures for compensating sagging (deflection) may or may not be provided.

In the illustrated case, segmented saddle 18 is cooled and unsegmented fixed saddle 34 is heated. The heating can occur similarly as in the embodiment according to, e.g., FIG. 2, such that friction heat can be used. Concerning the sliding of the belt on the saddle, it must be considered, though, that heat resistant material is used.

The cooling can be realized by cooling channels in each saddle 18 and/or by lubricant including, e.g., oil and water, which is applied to belt 20 in front of saddle 18. Steel belts 20, 22 are designed to be wider than screens 14 and 16. The medium used for lubrication between belts 20 and 22 and saddles 18 and 34, respectively, can easily be intercepted by sliding seals at the gliding side and the driving side next to the saddles at the belt and collected after the saddles, e.g., by a wedge-shaped scraper 40.

In FIG. 5, the heating device associated with heated fixed saddle 34 is labeled H. Cooling coils for the cooling medium of segmented saddle 18 are named $K_1$. Associated with unsegmented, fixed saddle 34 is a box 42.

The features resulting from the above description and the individual figures can also be provided separately or in any possible combination with each other.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

| | |
|---|---|
| 10 | Dewatering device |
| 12 | Material web |
| 14 | Finely structured screen |
| 16 | Coarsely structured screen |
| 18 | Segmented saddle |
| 18' | Saddle segments |
| 20 | Circulating flexible continuous belt |
| 220' | Cooled circulating flexible continuous belt |
| 22 | Opposite surface |

-continued

| LIST OF REFERENCE CHARACTERS | |
|---|---|
| 24 | Hinge points |
| 26 | Reduced material thickness, cuts |
| 28 | Saddle roller |
| 30 | Mating roller |
| 32 | Pressure element |
| 34 | Unsegmented saddle |
| 36 | Idle roller |
| 38 | Idle roller |
| 40 | Scraper |
| 42 | Box |
| D | Steam |
| H | Heating device |
| K | Cooling medium |
| L | Web travel direction |
| S | Nip |

What is claimed:

1. A dewatering device of a machine for at least one of production and processing of a material web comprising:

a circulating flexible continuous belt;

an opposite surface, which is heated to a temperature between about 100° C. and 250° C.;

said circulating flexible continuous belt and said opposite surface being arranged to form a nip elongated in a web travel direction, with a nip length between about 500 to 1000 mm;

at least one screen adapted to guide the material web through said nip; and a saddle arranged to support said circulating flexible continuous belt, said saddle being segmented in the web travel direction into saddle segments pivotably connected to each other, wherein said saddle segments are at least partially separately pressurized.

2. The dewatering device in accordance with claim 1, wherein said saddle segments are at least partially hinged to one another.

3. The dewatering device in accordance with claim 1, wherein said saddle segments are at least partially formed by areas of reduced material thickness of said saddle.

4. The dewatering device in accordance with claim 3, wherein said saddle comprises several consecutive cuts in the web travel direction on a side facing away from said nip.

5. The dewatering device in accordance with claim 3, wherein said saddle further comprises a normal profile region and a relieving region, and wherein said relieving region is composed of said saddle segments.

6. The dewatering device in accordance with claim 1, wherein different pressure profiles are achieved in said nip by changing pressurization of said saddle segments.

7. The dewatering device in accordance with claim 1, wherein said opposite surface comprises a saddle, and wherein a pressure in said nip is produced between said saddles.

8. The dewatering device in accordance with claim 7, wherein said saddle of said opposite surface is segmented.

9. The dewatering device in accordance with claim 7, wherein said saddle of said opposite surface is non-segmented.

10. The dewatering device in accordance with claim 1, wherein a surface of at least one of said flexible continuous belt and said opposite surface is structured and arranged for support of pressure compensation in an exit area of said nip.

11. The dewatering device in accordance with claim 10, wherein said surface is grooved.

12. The dewatering device in accordance with claim 1, wherein said circulating flexible continuous belt comprises a flexible roller jacket of a saddle roller.

13. The dewatering device in accordance with claim 1, wherein said opposite surface comprises a mating roller.

14. The dewatering device in accordance with claim 13, wherein said mating roller comprises a roller supported on its inside.

15. The dewatering device in accordance with claim 14, wherein said mating roller comprises a sag compensation roller.

16. The dewatering device in accordance with claim 1, wherein said flexible continuous belt is cooled and said opposite surface is heated.

17. The dewatering device in accordance with claim 16, wherein a cooling medium flows through said segmented saddle.

18. The dewatering device in accordance with claim 16, wherein said flexible continuous belt is cooled from one of outside and inside.

19. The dewatering device in accordance with claim 1, wherein said flexible continuous belt is at least partially cooled on an inside by a lubricant provided to lubricate an area between said saddle and said continuous belt.

20. The dewatering device in accordance with claim 1, wherein said at least one screen is cooled before said nip, relative to the web travel direction.

21. The dewatering device in accordance with claim 1, wherein said flexible continuous belt comprises a steel belt.

22. The dewatering device in accordance with claim 1, wherein said flexible continuous belt is heated and said opposite surface is cooled.

23. The dewatering device in accordance with claim 1, wherein said flexible continuous belt and said opposite surface each comprise a steel belt, and said dewatering device further comprises an unsegmented saddle arranged to support said steel belt of said opposite surface, and wherein said segmented saddle is positioned opposite an unsegmented saddle.

24. The dewatering device in accordance with claim 23, further comprising two floating idle rollers, wherein said two steel belts each are guided around and driven by said two floating idle rollers.

25. The dewatering device in accordance with claim 24, wherein said two floating idle rollers comprise sag compensation rollers.

26. The dewatering device in accordance with claim 1, further comprising a separately cooled steel belt positioned on a side of said circulating flexible continuous belt.

27. The dewatering device in accordance with claim 1, wherein the material web comprises one of a paper and a cardboard web.

28. A glazing device of a machine for at least one of production and processing of a material web, comprising:

a heated roller comprising a saddle roller;

a mating roller;

said saddle roller and said mating roller being arranged to form a nip elongated in a web travel direction having a length of between about 500 mm and 1000 mm; and said saddle roller comprising a flexible roller jacket supported by a saddle, said saddle being segmented in the web travel direction into saddle segments pivotably connected to each other, wherein said saddle segments are at least partially pressurized separately, and wherein a surface of at least one of said heated roller and said mating roller has a temperature between about 100° C. and 250° C.

29. The glazing device in accordance with claim 28, wherein the material web comprises one of a paper and a cardboard web.

30. A process for dewatering a material web in an apparatus including a circulating flexible continuous belt and an opposite surface arranged to form a nip elongated in a web travel direction, at least one screen adapted to guide the material web through the nip, and a saddle arranged to support the circulating flexible continuous belt, which is segmented in the web travel direction into saddle segments pivotably connected to each other, the process comprising:

guiding the material web through the nip, which has a length between about 500 mm and 1000 mm; and at least partially separately pressurizing the saddle segments against the opposite surface, which has a temperature between about 100° C. and 250° C.

31. The process in accordance with claim 30, wherein a pressure profile is changed by changing the pressure applied to said saddle segments.

32. A process for glazing a material web in an apparatus including a heated roller comprising a saddle roller and a mating roller arranged to form a nip elongated in a web travel direction, the saddle roller includes a flexible roller jacket supported by a saddle, in which the saddle is segmented in the web travel direction into saddle segments pivotably connected to each other, the process comprising:

guiding the material web through the nip, which has a length between about 500 mm and 1000 mm; and at least partially separately pressurizing the saddle segments against the mating roller, in which a surface temperature of at least one of the mating roller and the heated roller is between about 100° C. and 250° C.

* * * * *